US007124509B1

(12) United States Patent
Hawk

(10) Patent No.: US 7,124,509 B1
(45) Date of Patent: Oct. 24, 2006

(54) SPRING POWERED TOGGLE JOINT LOCK FOR A FOLDING KNIFE

(76) Inventor: Grant Woodrow Hawk, Box 401, Idaho City, ID (US) 83631

( * ) Notice: Subject to any disclaimer, the term of this patent is extended or adjusted under 35 U.S.C. 154(b) by 0 days.

(21) Appl. No.: 10/944,298

(22) Filed: Sep. 17, 2004

Related U.S. Application Data

(60) Provisional application No. 60/503,663, filed on Sep. 19, 2003.

(51) Int. Cl.
*B26B 1/10* (2006.01)
*B26B 1/04* (2006.01)

(52) U.S. Cl. ..... 30/160; 30/157; 30/159; 30/161

(58) Field of Classification Search ..... 30/160, 30/161, 158, 153, 155, 156, 159, 157
See application file for complete search history.

(56) References Cited

U.S. PATENT DOCUMENTS

| | | | | | |
|---|---|---|---|---|---|
| 947,980 | A * | 2/1910 | Romano | 30/153 |
| 1,319,532 | A * | 10/1919 | Rasmussen | 30/159 |
| 1,440,793 | A * | 1/1923 | Rasmussen | 30/159 |
| 1,451,607 | A * | 4/1923 | Bates | 30/161 |
| 1,478,260 | A * | 12/1923 | Sibley | 30/157 |
| 1,743,022 | A * | 1/1930 | Carman | 30/161 |
| 4,612,706 | A | 9/1986 | Yunes | |
| 4,776,094 | A * | 10/1988 | Glesser | 30/160 |
| 4,811,486 | A * | 3/1989 | Cunningham | 30/161 |
| 4,974,323 | A * | 12/1990 | Cassady | 30/155 |
| 5,029,355 | A * | 7/1991 | Thai | 7/118 |
| 5,095,624 | A | 3/1992 | Ennis | |
| 5,400,509 | A * | 3/1995 | Collins | 30/161 |
| 5,426,855 | A | 6/1995 | Keklak | |
| 5,815,927 | A * | 10/1998 | Collins | 30/161 |
| 6,523,265 | B1 * | 2/2003 | Eickhorn | 30/161 |
| 6,813,833 | B1 * | 11/2004 | Saunders et al. | 30/162 |
| 2003/0226260 | A1 * | 12/2003 | Sullivan | 30/160 |
| 2005/0055833 | A1 * | 3/2005 | Scarla | 30/156 |

* cited by examiner

*Primary Examiner*—Allan N. Shoap
*Assistant Examiner*—Ghassem Alie
(74) *Attorney, Agent, or Firm*—Robert A. Huntsman

(57) ABSTRACT

A "spring powered toggle joint lock" for a folding knife; comprising a blade lock of three primary elements. A rotating toggle link at the rear of the knife handle connected by a pivoting knee joint to a traveling toggle, which is in turn pivotally joined to the tang of the opening and closing blade. A spring configured so as to constantly urge the pivot points of the rotating toggle and traveling toggle into a straight line, generating an over-center action. The effect of the spring and toggle combination is to propel the opening blade towards open and the closing blade towards closed. Control pins attached to the traveling toggle and protruding to the surface of the handle, on both sides of the handle, provides the means to collapse the toggle lockup by thumb pressure, thereby allowing ambidextrous, one handed manipulation of a toggle locking folding knife.

7 Claims, 3 Drawing Sheets

26

42
30
24
12
34

24
30
42
32
26
16
12
32
20

50
24
26
32
16
16
32
42
30
20

12
50
24

SPRING POWERED TOGGLE JOINT LOCK FOR A FOLDING KNIFE

CROSS-REFERENCE TO RELATED APPLICATIONS

This application claims the benefit of provisional patent application Ser. No. 60/503/663, filed Sep. 19, 2003 by the present inventor.

FEDERALLY SPONSERED RESEARCH

Not Applicable

SEQUENCE LISTING OR PROGRAM

Not Applicable

BACKGROUND OF THE INVENTION

1. Field of Invention

This invention relates to a toggle joint, locking mechanism for a folding knife and more specifically to a spring powered, toggle joint, lock that allows for one handed opening and closing of a toggle joint, locking folding knife.

Although the toggle lock method of locking a folding knife is known to provide a very positive and safe lock up, designs of the past suffer disadvantages. Old designs requiring the use of both hands are no longer in favor to most consumers who insist on easy, one handed manipulation of a folding knife. What is needed is a spring powered toggle joint locking mechanism that overcomes these disadvantages.

2. Prior Art

The idea of using a toggle joint mechanism to lock the blade of a folding knife is not new. Yunes (4,612,706) Sep. 23, 1986 discloses a method of employing a toggle joint mechanism to lock a folding knife that is typical of the prior art. Typical, in that, all examples known to this applicant share a common disadvantage. That disadvantage is the necessity of using two hands to manipulate the opening and closing of the blade. This is a short coming unacceptable in today's market place.

OBJECTS AND ADVANTAGES

Accordingly, the object of the current invention is to solve the problems associated with the use of a toggle joint, locking mechanism for a folding knife. The spring powered toggle joint lock mechanism disclosed herein provides the means to automatically complete the locking cycle of the toggle joint without the use of a second hand. The configuration of the spring and toggle joint generates an over center action that has the effect of holding the blade closed under spring pressure when the knife is in its folded or closed position and also forces the toggle into complete lock up when the blade is moved into the extended or open position, thereby allowing one handed opening of the blade. Closing of the blade is accomplished by the manipulation of control pins attached to the traveling toggle and protruding through the handle frames on both sides.

The chief advantages of the spring powered toggle link locking mechanism for a folding knife, as herein disclosed are as follows: (a) the spring powered toggle link mechanism allows the construction of a very strong locking system that can be easily opened or closed with one hand. (b) Because the lock relies only on the geometry of freely rotating pivot points as opposed to spring loaded parts rubbing against the rotating blade tang, the opening and closing of the blade is surprisingly smooth. (c) Because the lock is completely symmetrical from left to right the mechanism can be manipulated, left handed or right handed, with equal ease.

DRAWING

FIGURES

In the drawings, closely related figures have the same number but different alphabetic suffixes.

REFERENCE NUMERALS

| | |
|---|---|
| 10 Blade | 12 Toggle knee joint pivot point |
| 14 Stop pin | 16 Interface toggle stop |
| 18 Handle frame | 20 Center of rotation of rotating toggle |
| 22 thumb wheels | 24 Control pin |
| 26 Spring | 28 Blade pivot point |
| 30 Traveling toggle | 32 Spring fulcrum point |
| 34 Rotating toggle | 36 Arc of spring travel |
| 38 Cam lobe of rotating toggle | 40 Eccentric locking screws |
| 42 Traveling toggle to blade pivot point | 44 Handle overlays |
| 46 Center pin for rotating toggle with eccentric bosses | 48 Arc of rotating toggle |
| 50 Spring notch | 52 Handle overlay screws |
| 54 Handle frame counter bores | |

SUMMARY OF THE INVENTION

In accordance with the present invention, a spring powered, toggle joint, lock for a folding knife. Such knife configured with a spring so as to propel the closing blade towards closed and the opening blade towards open. A cam shaped rear toggle inducing an added element of torque in response to spring pressure in order to ensure a complete lockup. Control pins easily assessable to the user for the purpose of delocking the toggle joint, allowing one handed opening and closing of a toggle locking folding knife.

DETAILED DESCRIPTION OF THE PREFERRED EMBODIMENT

Figure 1:
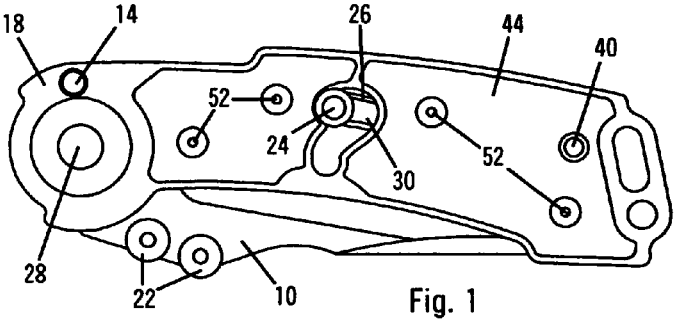
FIG. 1 shows the completed folding knife in plan view
Figure 2A:
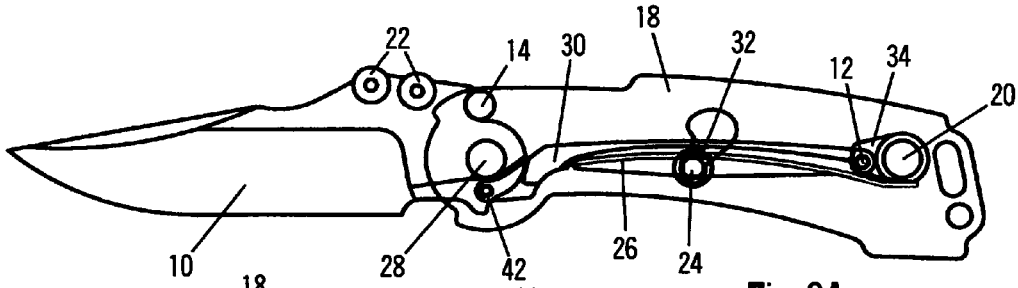
FIG. 2A shows a cutaway view of knife exposing the internal toggle link mechanism with blade open.
Figure 2B:
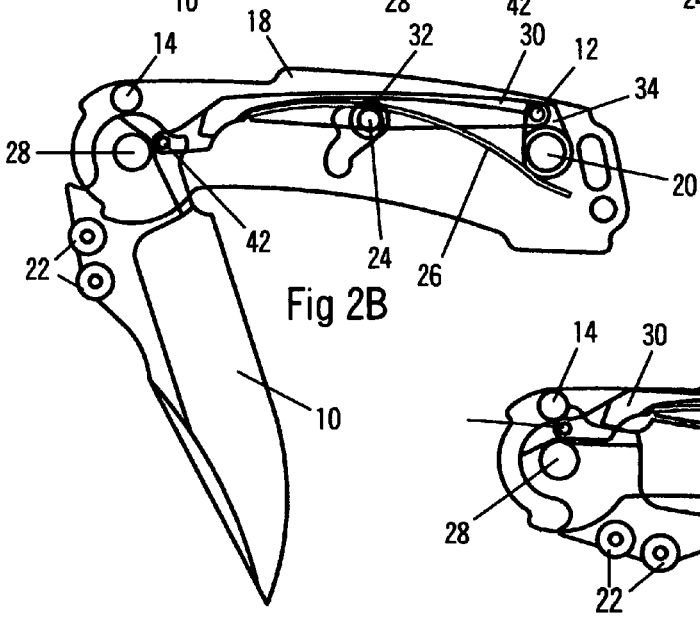
FIG. 2B shows a cutaway view with blade at halfway point
Figure 2C:
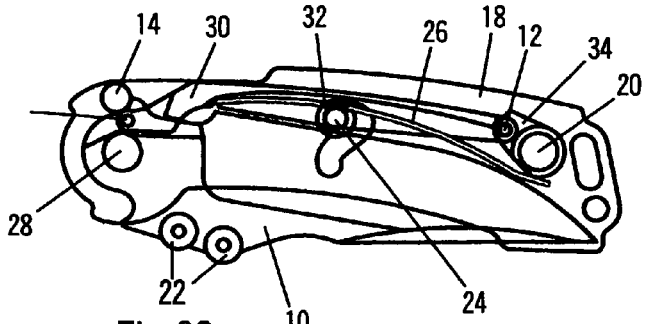
FIG. 2C shows a cutaway view with blade completely closed
Figures 3, 4, 5A, 5B:
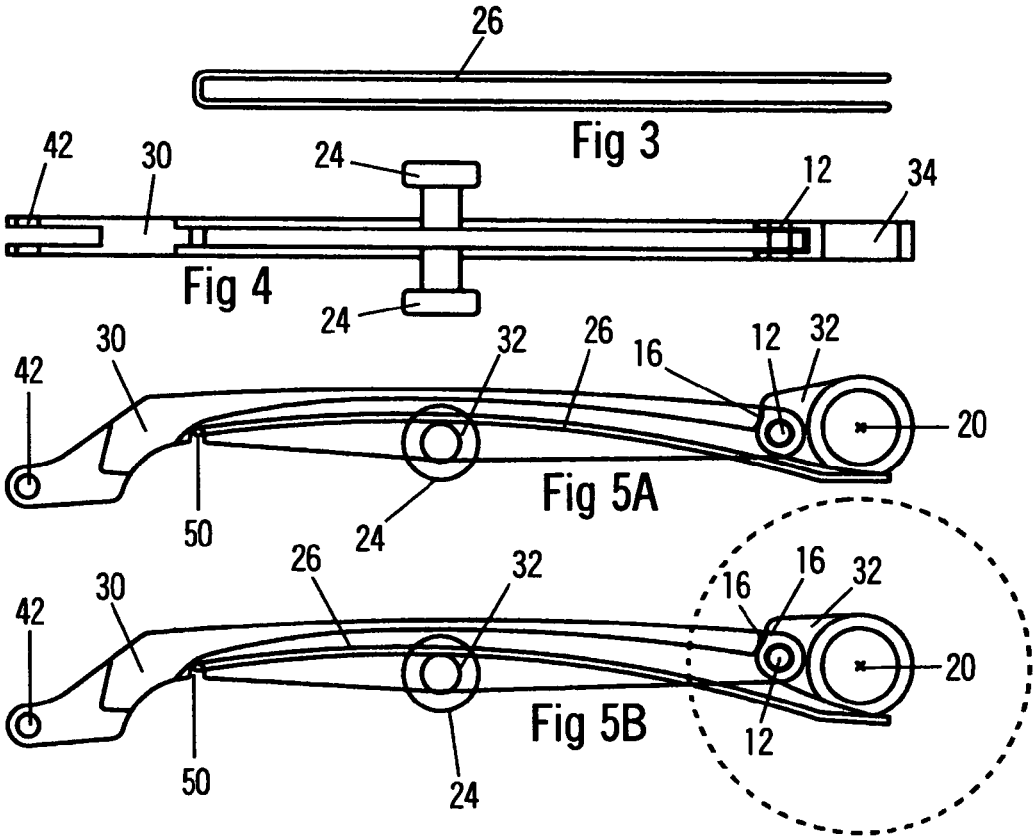
FIG. 3 shows a fabricated spring
FIG. 4 shows bottom view of toggle links and control pins
FIG. 5A shows plan view of toggle links with spring installed, fully extended
FIG. 5B shows plan view of toggle links at a point of travel slightly before fully extended, encircled area indicates area shown enlarged in FIG. 6
Figure 6:
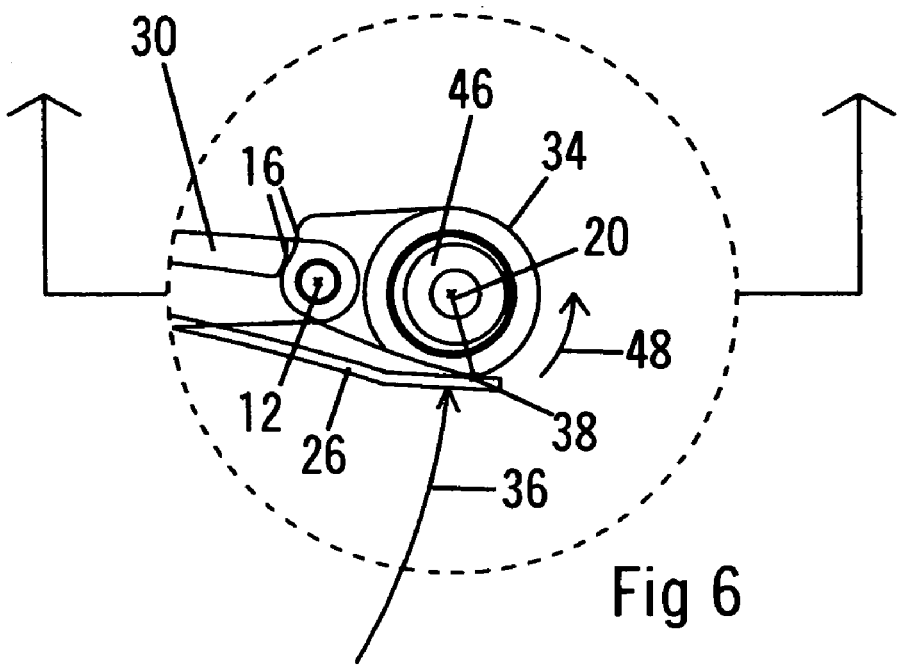
FIG. 6 shows enlarged area with eccentric pin and indicates cross section shown in FIG. 7
Figure 7:
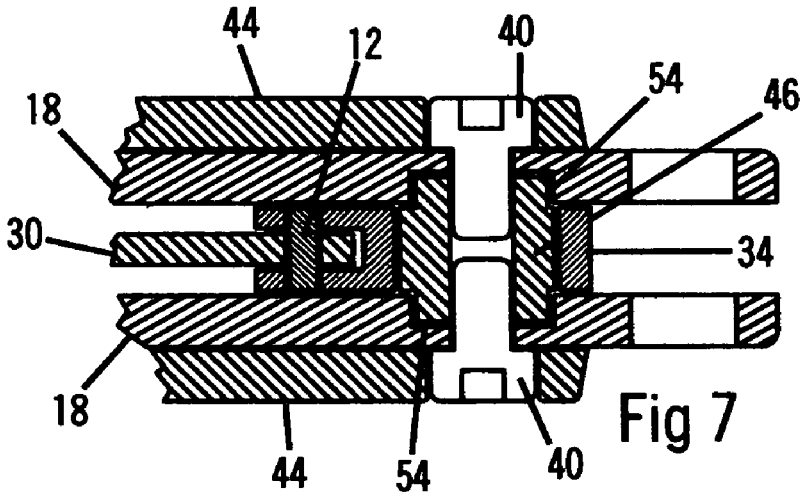
FIG. 7 shows cross section of complete assembly through area indicated in FIG. 6 detailing eccentric pin and counter bore engagement with handle frames.

A typical embodiment of the "spring powered toggle joint lock" of the present invention is shown at the figures listed below. FIG. 1 shows a plan view of a completely assembled folding knife in the closed position. FIG. 2C shows the same knife in the same closed position but cutaway to reveal the internal components. In FIG. 2C the traveling toggle 30 is pinned to the blade 10 at the traveling toggle to blade, pivot point 42 at its forward end and pinned to the rotating toggle 34 at the toggle knee joint pivot point 12 at its rearward end. The knife of FIG. 2C is held closed by the spring 26 which is more clearly defined in FIGS. 3 through 5B. FIG. 2B shows the knife opened to its halfway point which represents the maximum loading of spring 26. FIG. 2A shows the knife in its fully opened and locked position at which point the toggle knee joint pivot point 12 comes to rest slightly beyond an imaginary straight line drawn between the center of rotation of the rotating toggle 20 and the traveling toggle to blade tang pivot point 42. FIG. 3 shows the fabricated configuration of spring 26. FIG. 4 shows a bottom view of the traveling toggle, the position of the control pins 24 and the spring notch 50 used to capture the front bent portion of spring 26. FIG. 5A shows the traveling toggle 30 pinned to rotating toggle 32 in the fully extended fully locked position of FIG. 2A. FIG. 5A shows spring 26 positioned in spring notch 50 and bent over the control pins 24 at the spring fulcrum point 32. FIG. 5B shows a view of the same components as FIG. 5A but at a point of travel just slightly before final lock up, the area encircled indicates the enlarged detail shown at FIG. 6. FIG. 6 shows the relative position of the locking elements just before lock up. In FIG. 6 the interfacing toggle steps 16 of the traveling toggle and the rotating toggle are close to engagement. The cam lobe of the rotating toggle 38 has passed through the arc of spring travel 36 thereby inducing an added element of torque to rotating toggle 34 in the direction of arc 48 of rotating toggle. FIG. 7 is a cross section of the fully assembled knife through the area indicated in FIG. 6. FIG. 7 shows the center pin for rotating toggle with eccentric bosses 46 located between handle frames 18 and captured in position by handle frame counter bores 54 and locked in proper adjustment by eccentric locking screws 40.

OPERATION

In operation, movement is initiated by opening the blade 10 FIG. 2C using the thumb to push against the thumb wheels 22 FIG. 2C affixed to both sides of the blade 10. As the blade opens, the preloaded spring 26 FIG. 2C is further loaded until reaching the halfway point of its travel as shown in FIG. 2B at which point the spring 26 begins to unload it's stored energy, thereby contributing to the force necessary to fully open the blade 10 as in FIG. 2A.

As the toggle link mechanism FIG. 5B approaches its final lock up and as the cam lobe point 38 of the rotating toggle 34 passes beyond the arc 36 that describes the line of force of spring 26 against the rotating toggle 34, the spring 26 begins to act against the lobe point 38 exerting an additional element of toque to the rotating toggle 34, further urging all elements of the toggle link mechanism into full lock up as shown in FIG. 5A. The full lock up as shown in FIG. 5A is achieved when the corresponding interfacing features 16 of the rotating toggle 34 come to rest against the corresponding interfacing features of the traveling toggle 30 so as to stop further relative travel between the rotating toggle 34 and the traveling toggle 30. This stopping point is configured so as to allow an imaginary straight line to be drawn through the center of rotation 20 of the rotating toggle 34, the knee joint pivot point 12 and the traveling toggle to blade tang pivot point 42. In practice the knee joint 12 is allowed to go slightly past the imaginary straight line so as to insure a safe lock up.

Closing the blade 10 is accomplished by applying thumb or finger pressure against control pin 24 in the direction that collapses the knee joint 12 and sends blade 10 back to the half way point of FIG. 2B at which point spring 26 propels the blade to fully closed as in FIG. 2C. The length of control pins 24 are made flush with the uppermost surface of handle overlays 44 held by screws 52 to prevent accidental unlocking.

To optimize performance an adjustment mechanism is included so the length of the locked toggle joint can be adjusted. As one skilled the art will appreciate, referring to FIG. 7, adjustment is made by loosening the locking screws 40, rotating the center pin 46, and retightening the locking screws 40. As illustrated in FIG. 6, the eccentric nature of the center pin 46 causes the center of rotation of the rotating toggle link 20 to be moved as the center pin 46 is rotated. It is intended that this adjustment be made at the time of manufacture and occasionally in the field. In the preferred embodiment, the consumer will generally NOT make this adjustment.

Accordingly, the reader can see that the spring powered toggle joint lock of this invention constitutes a substantial improvement to a toggle locking folding knife. Specifically, the present invention provides an elegant solution to previous toggle knives requiring two handed operation. Although the description contained herein contains many specific details, these should not be construed as limiting the scope of the invention but merely as providing an illustration of the preferred embodiment of the invention.

What is claimed is:

1. A locking mechanism for a folding knife having a blade comprising:

a toggle joint linkage comprising a traveling toggle link, the traveling toggle link having a free end, a rotating toggle link, the traveling toggle link and the rotating toggle link are pinned together to form a pivoting knee joint, the blade further comprises a rotating tang, a spring, the spring is configured to constantly urge the toggle joint linkage into a straight line, and a center of rotation, wherein the free end of the traveling toggle link is pinned to the rotating tang of the blade and the rotating toggle link is constrained to rotate about the center of rotation..

2. The locking mechanism of claim 1 further comprising a center pin, the center pin establishes said center of rotation, wherein said rotating toggle link includes a cam lobe, and said traveling toggle link includes a blade pivot point, wherein the rotating toggle link is configured to interface with said spring, wherein when the cam lobe contacts the spring, the torque of the rotating toggle link is increased by shifting the relative point of contact between the center of rotation and the spring, wherein said toggle joint linkage locks when the center of rotation, said knee joint pivot point, and the blade pivot point achieve a substantially linear position.

3. The locking mechanism of claim 1 wherein said center of rotation is adjustable wherein the length of said toggle joint linkage can be optimally adjusted.

4. The locking mechanism of claim 3 further comprising an eccentrically configured center pin having locking screws, said rotating toggle link includes a center of rotation, wherein the eccentrically configured center pin establishes said center of rotation of the rotating toggle link wherein said center of rotation is adjusted by loosening the locking screws, rotating the eccentrically configured center pin and tightening the locking screws, wherein the length of said toggle joint linkage can be optimally adjusted.

5. The locking mechanism of claim 1 further comprising a control pin, the control pin positioned such that engaging the control pin collapses said knee joint, the mechanism further comprising an open blade wherein the blade is capable of being closed by a single hand pushing the control pin, wherein the control pin causes said knee joint to collapse, the collapsed knee joint sends the blade to a half closed position, wherein said spring then propels said blade to closed position.

6. The locking mechanism of claim 1 further comprising a closed blade, wherein said spring is partially loaded, urging the blade closed, wherein the blade is capable of being opened by a single hand urging the blade against tension of said spring to further load said spring, moving the blade to the half opened position wherein said spring then cooperatively unloads its stored energy and propels the blade opened and the locking mechanism to its locked position.

7. The locking mechanism of claim 6 wherein the blade includes at least one thumb wheel attached to said blade wherein said single hand engages the thumb wheel to initially urge the blade to the opened position.

* * * * *